US006782661B2

(12) United States Patent
Manzella

(10) Patent No.: US 6,782,661 B2
(45) Date of Patent: Aug. 31, 2004

(54) MECHANICAL ACTUATOR FOR A MULTI-POSITION WINDOW

(76) Inventor: Francis Manzella, 412 Woodbridge Rd., Rockville Centre, NY (US) 11570

( * ) Notice: Subject to any disclaimer, the term of this patent is extended or adjusted under 35 U.S.C. 154(b) by 0 days.

(21) Appl. No.: 09/804,442

(22) Filed: Mar. 12, 2001

(65) Prior Publication Data

US 2002/0124468 A1 Sep. 12, 2002

(51) Int. Cl.[7] ..... E05D 15/52; E05D 15/524
(52) U.S. Cl. ..... 49/192; 49/382
(58) Field of Search ..... 49/192, 382, 394, 49/348, 336, 337

(56) References Cited

U.S. PATENT DOCUMENTS 1,641,738 A * 9/1927 Clarke ..... 49/336
2,036,151 A * 3/1936 Lang ..... 292/112
2,159,421 A * 5/1939 Bryson ..... 192/223.1
3,004,304 A * 10/1961 Frank ..... 49/192
3,308,579 A * 3/1967 Thams ..... 292/39
3,434,238 A * 3/1969 Muller ..... 16/230
3,667,162 A * 6/1972 Lalague ..... 49/192
3,802,124 A * 4/1974 Guerrini ..... 49/192
3,911,621 A 10/1975 McHeffey
4,074,462 A 2/1978 McHeffey
4,339,892 A 7/1982 Ulbricht et al.
4,532,673 A * 8/1985 Kim ..... 16/230
4,624,075 A * 11/1986 Vigreux ..... 451/164
4,640,051 A 2/1987 Maier et al.
4,679,352 A * 7/1987 Bates ..... 49/192
4,807,914 A * 2/1989 Fleming ..... 292/48
4,860,493 A * 8/1989 Lense ..... 49/279
4,903,434 A * 2/1990 Loos ..... 49/192
4,942,694 A * 7/1990 Simoncelli ..... 49/192
5,052,079 A * 10/1991 Vosskotter ..... 16/367
RE34,230 E * 4/1993 Tucker et al. ..... 49/279
5,226,256 A * 7/1993 Fries et al. ..... 49/13
5,881,498 A 3/1999 Goggin et al.
6,021,603 A 2/2000 Prete et al.

* cited by examiner

*Primary Examiner*—Gregory J. Strimbu
(74) *Attorney, Agent, or Firm*—Gerald T. Bodner

(57) ABSTRACT

A multi-position window includes a stationary window frame, a sash window frame positioned within the stationary window frame and selectively pivotable out of the stationary window frame about a vertical axis and a horizontal axis, and a drive train positioned between the sash window frame and the stationary window frame. The drive train is preferably moveable between at least a first position which enables the sash window frame to be pivoted about the vertical axis and a second position which enables the sash window frame to be pivoted about the horizontal axis. The drive train is preferably moved by a mechanical actuator having a worm gear, pinion gear and rack which is concealed in the sash window frame to create a pleasing aesthetic appearance and is operatively connected to the drive train to move the drive train from the first position to the second position.

19 Claims, 8 Drawing Sheets

Fig. 7
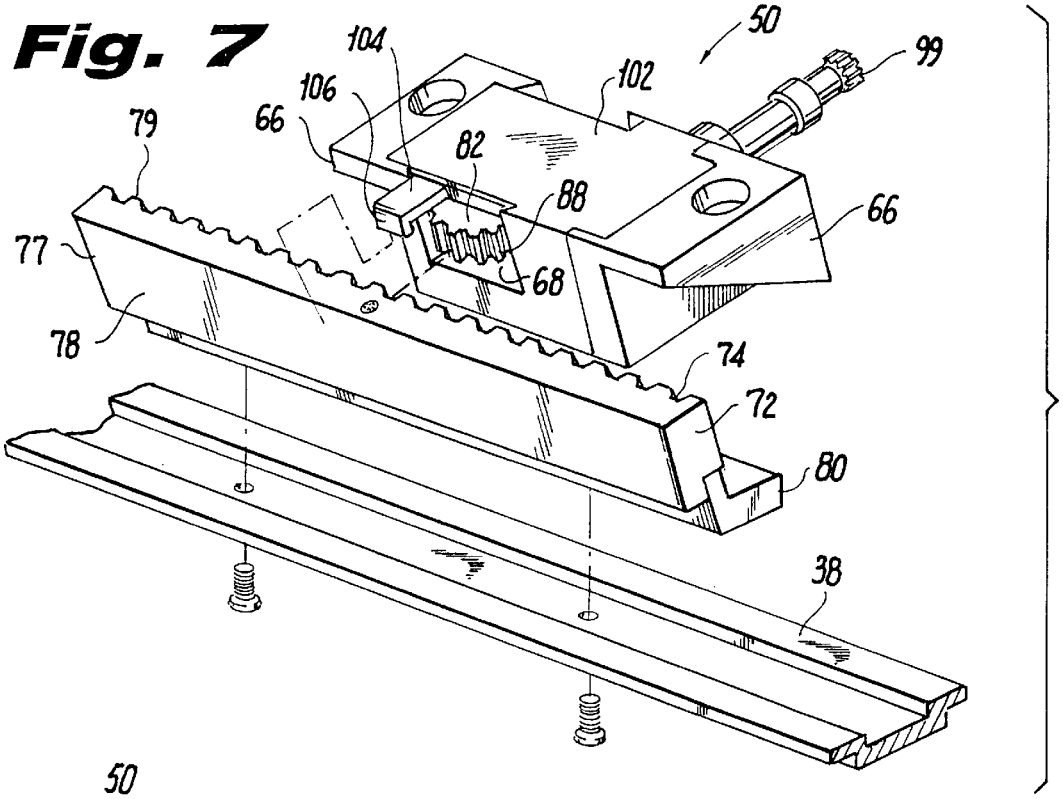
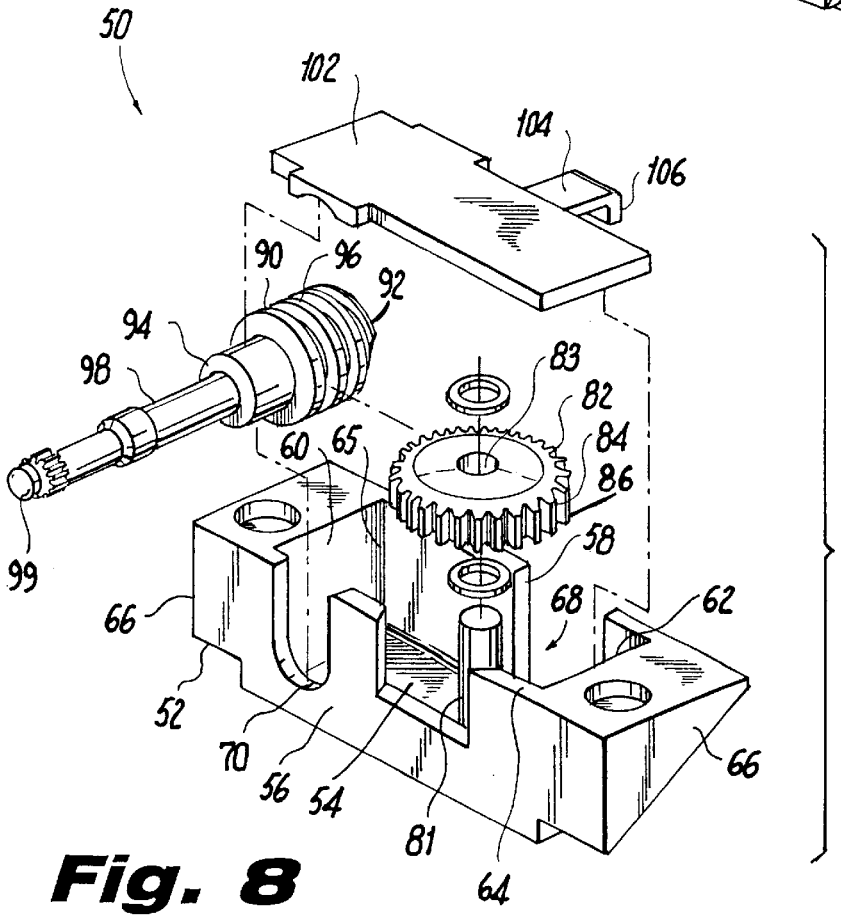
Fig. 8

MECHANICAL ACTUATOR FOR A MULTI-POSITION WINDOW

BACKGROUND OF THE INVENTION

1. Field of the Invention

The present invention relates to a mechanical actuator for multi-position windows, and more particularly, the present invention relates to a mechanical actuator which selectively adjusts and controls the rotation of the window about a vertical axis or a horizontal axis.

2. Description of the Prior Art

There are many designs for mechanical actuators for multi-position windows or French windows, as they are commonly known. Multi-position windows allow the window sash to tilt inward about a horizontal axis so that the window can be used to vent air, or in the alternative, the window sash may be rotated about a vertical axis so that it opens like a standard casement window, except preferably inwardly rather than outwardly. One advantage of a multi-position window is that, in high rise buildings, should a user want to simply allow some air to be vented into a room, the tilt option of the window may be used to allow free air flow; however, the user will not be in danger of falling out of the window since the window cannot be opened an extreme amount. When the window needs to be cleaned, such as by maintenance crews, the window can then be opened about the vertical axis and rotated inwardly into the room so that the outside surface may be easily cleaned.

The typical mechanisms for operating the multi-position windows are well known in the art. U.S. Pat. No. 3,911,621 to McHeffey describes a tilt and turn window having a drive train around three sides of the sash. The drive train is moved laterally by a three position handle. The movement of the drive train switches the sash from a lock down position in the window frame to a position enabling rotation out of the window frame on a vertical axis and finally to a position enabling rotation out of the window frame on a horizontal axis.

When the handle is moved upwardly from a horizontal, center position, the drive train is moved counterclockwise, thereby setting the window sash for rotation out of the window frame on a horizontal axis so that the window may be tilted into the room. When the handle is moved downward from the center position, the drive train moves clockwise, setting the window sash for rotation out of the window frame on the vertical axis to allow it to swing inwardly. Depending on the user's needs, the window can be rotated about either axis depending on the position of the handle.

However, one disadvantage of the multi-purpose window disclosed in the McHeffey patent is that, once the window is opened, the window may be slammed shut by a gust of wind or inadvertent jostling of the window while it is open, thereby damaging the mechanism in the window sash or the window itself. The window may also be slammed shut by a negative pressure situation that is sometimes experienced with windows positioned on a corner of a building or when there are high winds blowing past the window. The wind blowing past the window may create a negative pressure on the outside of the window thereby allowing the air pressure inside the building to slam the window closed. Since the mechanical actuator and the drive train disclosed in the McHeffey patent only allow an unlocking of the window from the locked position to allow the window to be opened into either of the desired positions, the window can easily be slammed shut or violently opened since there is no resistive force stopping the window from moving. Furthermore, the window cannot be partially tilted inwardly.

U.S. Pat. No. 4,640,051 to Maier et al. discloses an adjustable mechanical actuator for a multi-position window. The Maier et al. patent discloses a mechanism having a spindle positioned on the outside of the sash window frame with a bar which extends through the sash window face and is connected to the drive train such that rotation of the spindle causes the bar to move the drive train. The Maier et al. patent teaches that the spindle would be rotated by a beveled gear positioned on the same axis of rotation of the spindle by a handle rotatably mounted to the mechanism housing. The rotation of the handle would interact with the beveled gear to rotate the spindle to cause the bar to move in a vertical direction, either up or down, depending on the direction of the rotation of the handle of the mechanical actuator. The window could not be slammed closed, since the Maier et al. patent allows adjustments to the degree to which the window is opened and closed by the use of the bar and spindle arrangement.

However, a disadvantage to the Maier et al. design is that it is positioned completely on the outside of the window sash housing, thereby creating an unsightly aesthetic appearance. In addition, the Maier et al. design discloses that the locked position for the sash window is such that the user would only have a visual indicator on the adjustable mechanism to indicate that the window is locked. The user would have to rotate the handle in a clockwise direction to open the window in the tilt mode and then rotate the handle counterclockwise to the locked position. The user would then continue rotating the handle in a counterclockwise direction to open the window about the vertical axis. The user may inadvertently turn the handle past the locked position and inadvertently think that the window is locked when, in fact, it is not, thereby increasing the chance of injury if the window were to be blown open by a strong wind.

OBJECTS AND SUMMARY OF THE INVENTION

It would be desirable to have a mechanical actuator for a multi-position window that is compact and is easily concealed within the sash window frame.

It would be desirable to have a mechanical actuator which decreases or eliminates the possibility of the user inadvertently leaving the window in an open position.

It would further be desirable to have a mechanical actuator with a visual indicator to alert the user when the sash window frame is in the unlocked position and that allows rotation of the sash window frame about the vertical axis.

One advantage of the present invention is to provide a mechanical actuator for a multi-position window which allows the user to selectively move the sash window frame from one position to another without the danger of the sash window frame being slammed shut from either inadvertent pushing on the sash window frame by the user or by a gust of wind.

Another advantage of the present invention is to provide a mechanical actuator for a multi-position window that is concealed within the window sash thereby creating a clean aesthetic appearance.

It is still another advantage of the present invention to provide a safety lock for a multi-position window in conjunction with the mechanical actuator of the present invention so as to prevent rotation about the vertical axis while not interfering with the pivoting of the sash about the horizontal axis and only allowing pivoting about the vertical axis when desired by the user.

In accordance with the present invention, a multi-position window preferably includes a stationary window frame, a sash window frame positioned within the stationary window frame selectively pivotal out of the stationary window frame about a vertical axis and a horizontal axis, and a drive train positioned between the sash window frame and the stationary window frame. The drive train is preferably moveable between at least a first position, which enables the sash window frame to be pivoted about the vertical axis, and a second position, which enables that sash window frame to be pivoted about the horizontal axis. The drive train is preferably moved by a mechanical actuator which is operatively connected to the drive train to move the drive train from the first position to the second position. The mechanical actuator is preferably concealed within the sash window frame to create a clean aesthetic appearance.

The mechanical actuator preferably includes a housing positioned within a sash window frame containing a rack and pinion gear system for selectively moving the drive train of the multi-position window. The pinion gear is rotatably mounted within the housing which engages a rack which is preferably directly attached to a slider in the drive train mechanism. The pinion gear is preferably rotated by a worm gear which is rotatably mounted in the housing and attached to a handle located outside of the sash window frame. Preferably, there is a visual indicator on the mechanical actuator which alerts the user as to the various positions of the drive train as it is being moved from position to position. The present invention may further include a safety lock mechanism which prevents inadvertent opening about the vertical axis unless specifically disengaged by the user.

These and other objects, features, and advantages of the present invention will be apparent from the following detailed description of illustrative embodiments thereof, which is to be read in connection with the accompanying drawings.

BRIEF DESCRIPTION OF THE DRAWINGS

FIG. 7 is an exploded perspective of the mechanical actuator of the present invention and a slider bar;

FIG. 8 is an exploded perspective view of the mechanical actuator of the present invention;

DETAILED DESCRIPTION OF THE PREFERRED EMBODIMENTS

The present invention is a mechanical actuator which is designed to be used in conjunction with the drive train of a multi-position window, such as a tilt and turn window, such as disclosed in U.S. Pat. No. 5,881,498 to Goggin, et al., the disclosure of which is incorporated herein by reference, but even more preferably to a tilt before turn window such as disclosed in co-pending U.S. patent application Ser. No. 09/526,918, filed Mar. 16, 2000, to Francis Manzella, entitled "Safety-Lock For Multi-position Window", the disclosure of which is also incorporated herein by reference. As is typical with this style window, the drive train is mounted on a sash window frame and extends around one or more edges of the sash window frame. Prior designs have used a handle which is provided on the sash window frame wherein rotation of the handle causes linear movement of the drive train. Depending on the drive train position, the sash window frame is allowed to pivot about a horizontal axis or a vertical axis. However, the present invention envisions using a mechanical actuator which allows a handle to be rotated 360° to cause linear movement of the drive train.

Designs for drive trains for multi-position windows are well known in the art, and need not be described in detail in this disclosure. Drive trains for multi-positioned windows are described, for example, in U.S. Pat. Nos. 3,911,621; 4,074,462; 4,339,892; 4,624,075; and 5,881,498, the disclosures of which are incorporated herein by reference. It would be evident to one skilled in the art, given the following detailed description, of the modifications required to adapt the present invention for use with any drive train for a multi-positioned window.

Figure 1:
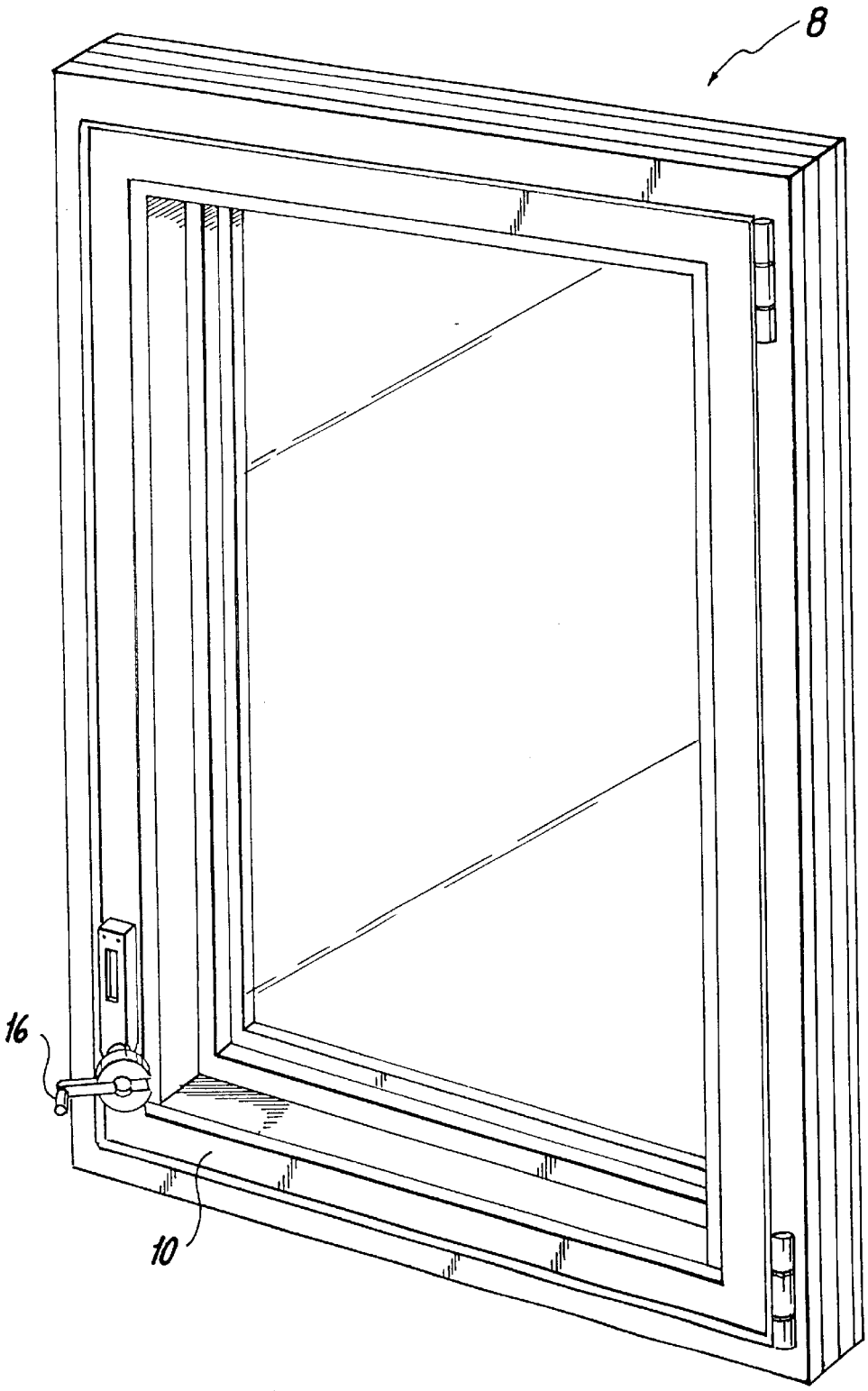
Fig. 1 (Prior Art)
FIG. 1 is a top perspective view of a conventional multi-position window with the sash window frame in the closed position.
Figure 2:
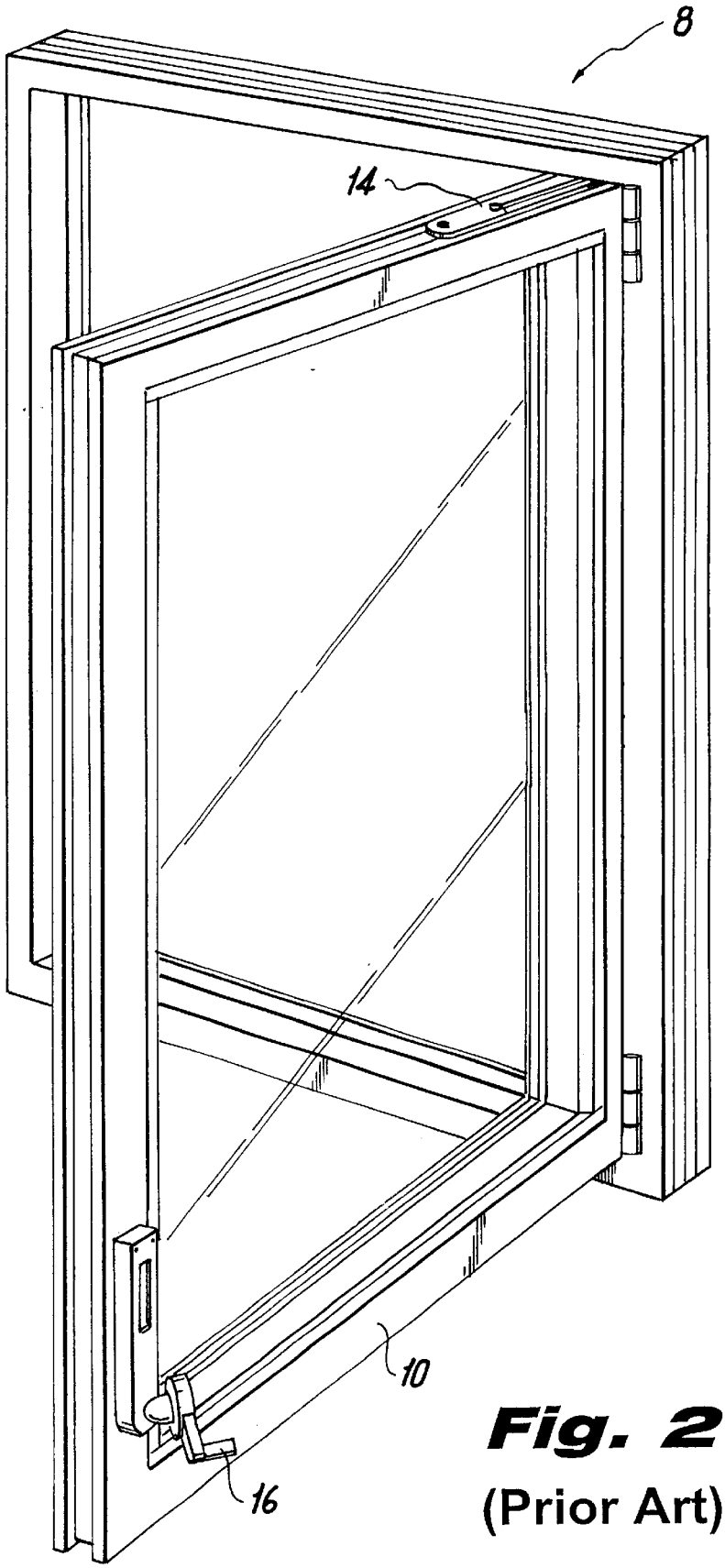
Fig. 2 (Prior Art)
FIG. 2 is a top perspective view of a conventional multi-position window with the sash window frame rotated about the vertical axis.
Figure 3:
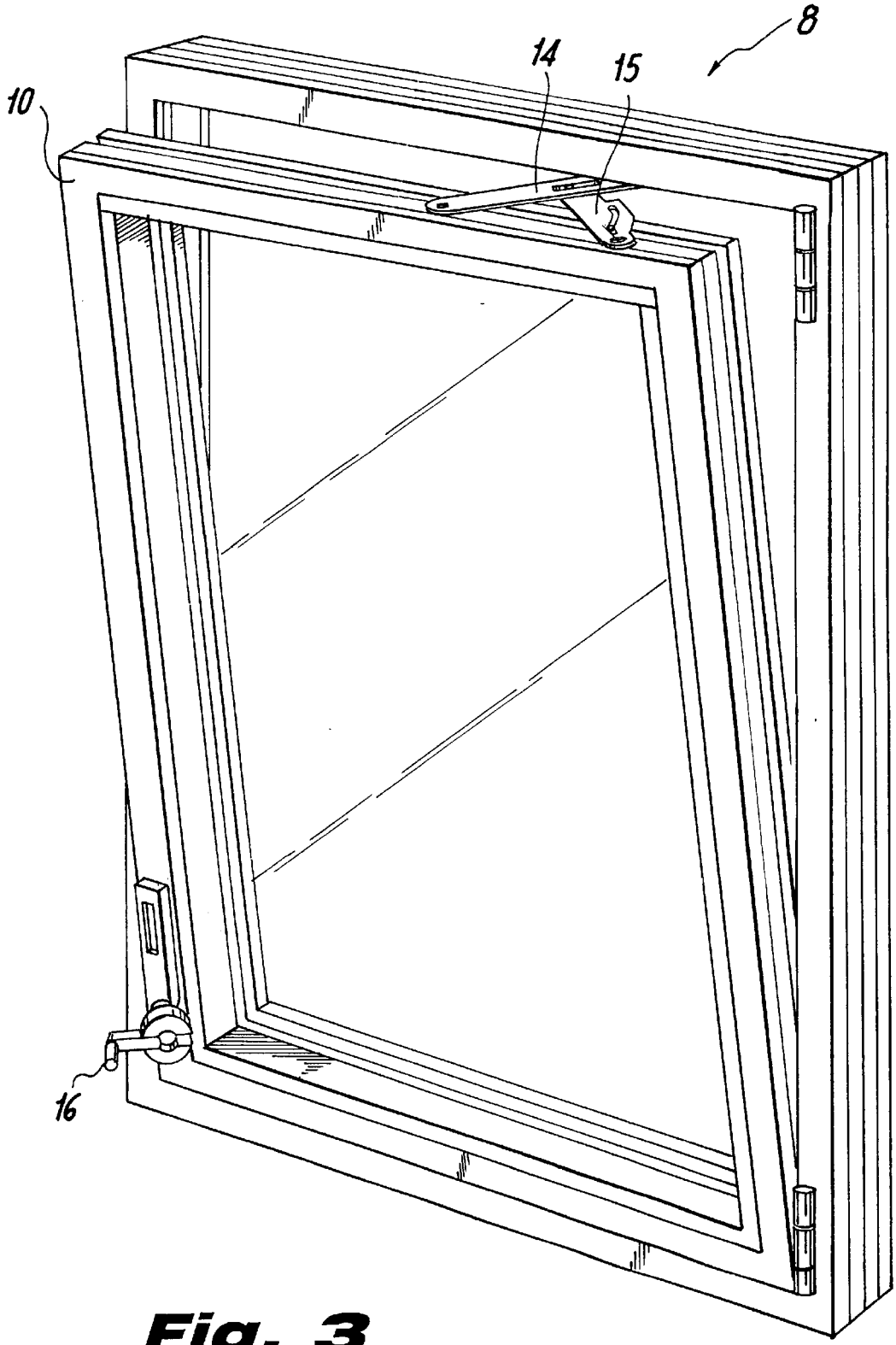
Fig. 3 (Prior Art)
FIG. 3 is a top perspective view of a conventional multi-position window with the sash window frame rotated about the horizontal axis.
Figure 4:
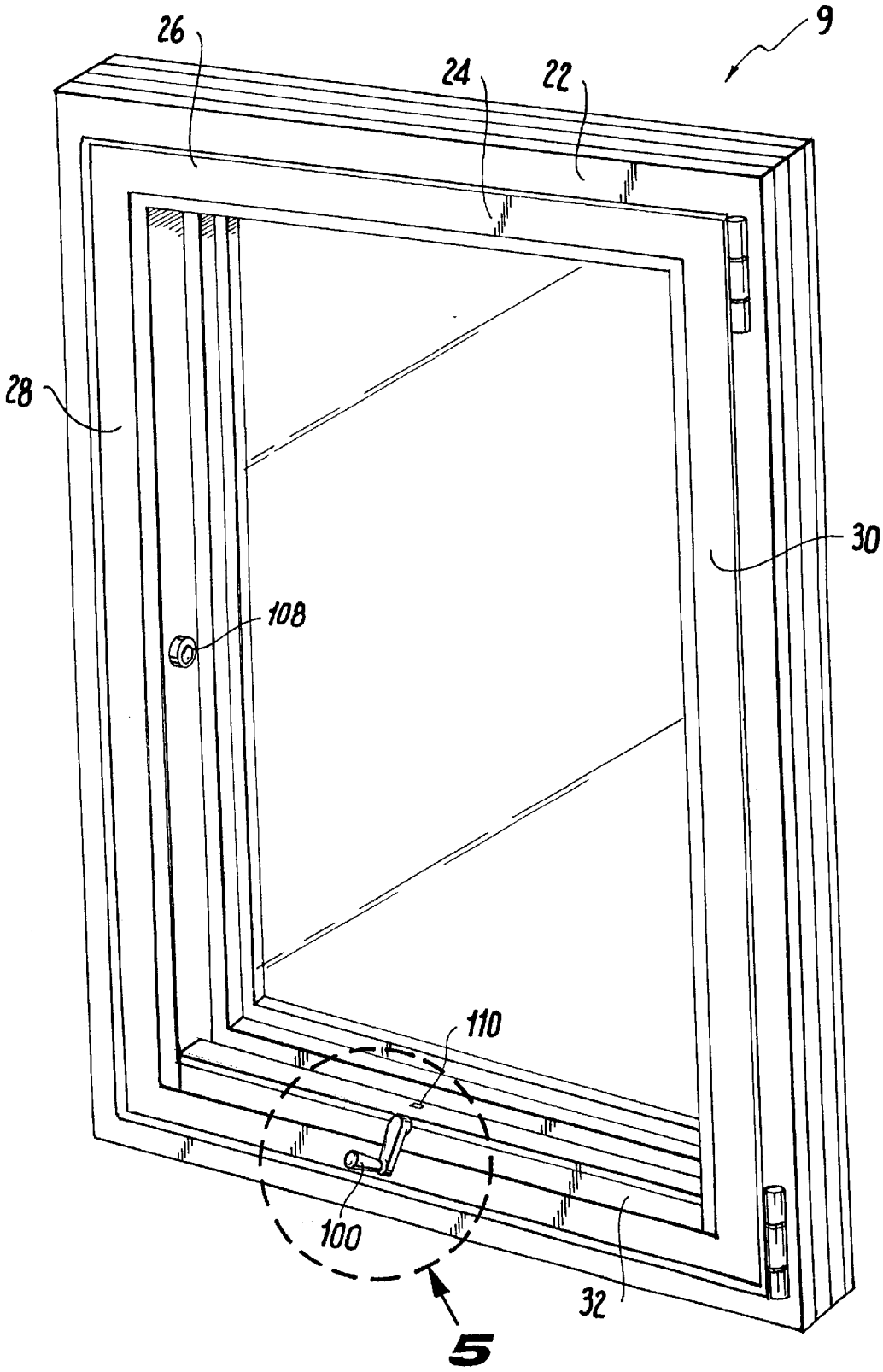
FIG. 4 is a top perspective view of a multi-position window incorporating the mechanical actuator of the present invention with the sash window frame in the closed position.

Referring now to the drawings, FIGS. 1–3 shows a conventional multi-position window 8 which uses a rotating handle 16 to operate the drive train 14. FIG. 1 shows the window in the locked position, and FIGS. 2 and 3 show the window in a position which allows the sash window frame 10 to rotate about the vertical and horizontal axes, respectively.

A drive train 14 is positioned between the sash window frame 10 and the stationary window frame 12. The drive train 14 is selectively moved between at least a first position, which enables the sash window frame 10 to be pivoted about the vertical axis (FIG. 2), and a second position, which enables the sash window frame 10 to be pivoted about the horizontal axis (FIG. 3). Referring to FIG. 3, the drive train 14 may include a kick out plate 15 which assists in preventing the sash window frame 10 from being slammed closed or inadvertently violently opened. The kick out plate 15 is also used to assist the sash window frame 10 to variably pivot about the horizontal axis.

Referring now to FIGS. 4–8, the mechanical actuator 50 of the present invention may be used in a multi-position window 9 that is similar in structure to a conventional window previously described herein. Components common to the prior art and the present invention will use identical reference numerals for clarity. The multi-position window 20 includes a stationary window frame 22 and a sash window frame 24 positioned within the stationary window frame 22. The sash window frame 24 is selectively pivotable out of the stationary window frame 22 about a horizontal axis (tilt in), and a vertical axis (swing in).

Preferably, the present invention includes a drive train 14 designed to be selectively movable between three positions. Placing the drive train 14 in the first position prevents the sash window frame 24 from being pivoted about the horizontal axis and the vertical axis. The first position effectively "locks down" the sash window frame 24 and prevents any and all movement of the sash window frame 24 with respect to the stationary window frame 22. Placing the drive train 14 in a second position enables the sash window frame 24 to be pivoted about the vertical axis. Placing the drive train 14 in a third position enables the sash window frame 24 to be pivoted about the horizontal axis. The drive train 14 may include a kick out plate 15 to allow the sash window frame 24 to variably pivot about the horizontal axis of the stationary window frame 22. The use of a kick out plate 15 is well known in the art and does not need to be described in detail in this disclosure.

In order to facilitate movement of the drive train 14, the sash window frame 24 is provided with a mechanical actuator 50. The mechanical actuator 50 is preferably mounted within the sash window frame 24 with the drive train 14 so that the movement of the mechanical actuator 50 causes movement in drive train 14 from one position to the next, i.e., from the first position to the second position, and from the second position to the third position, and its return movement from the third position to the second position and from the second position to the first position. As described above, the mechanism used to facilitate movement of the drive train 14 in relation to the mechanical actuator 50 is known in the art and need not be discussed in detail.

The present invention includes a sash window frame 24 having a top portion 26, a first side portion 28, a second side portion 30 opposite to and parallel with the first side portion 28, and a bottom portion 32 which is opposite to and parallel with the top portion 26. The drive train 14 is positioned around the perimeter 34 of the sash window frame 24. The present invention envisions using the mechanical actuator 50 on any of the portions of the sash window frame 24; however, for exemplary purposes, the mechanical actuator 50 is shown on the bottom portion 32. The drive train 14 is shown to extend on three sides of the sash window frame 24, namely, the top portion 26, first side portion 28 and bottom portion 32. The sliders 36, which are well known in the art, are positioned along the outer perimeter 34 of the sash window frame 24. The mechanical actuator 50 is preferably mechanically engaged with the bottom slider 38 of the drive train 14.

Figure 5:
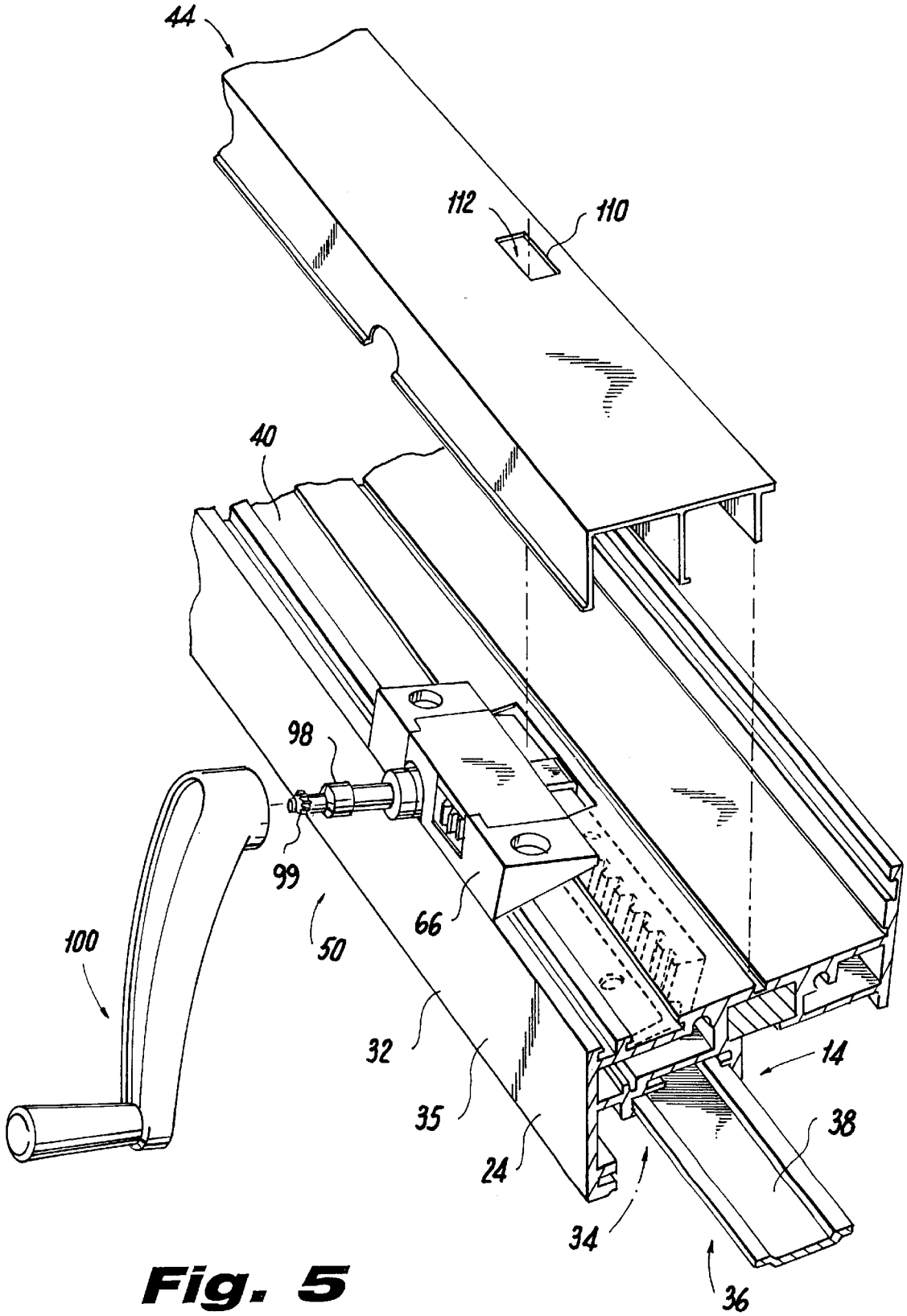
FIG. 5 is an exploded perspective view of the sash window frame and mechanical actuator of the present invention with the cover removed.
Figure 6:
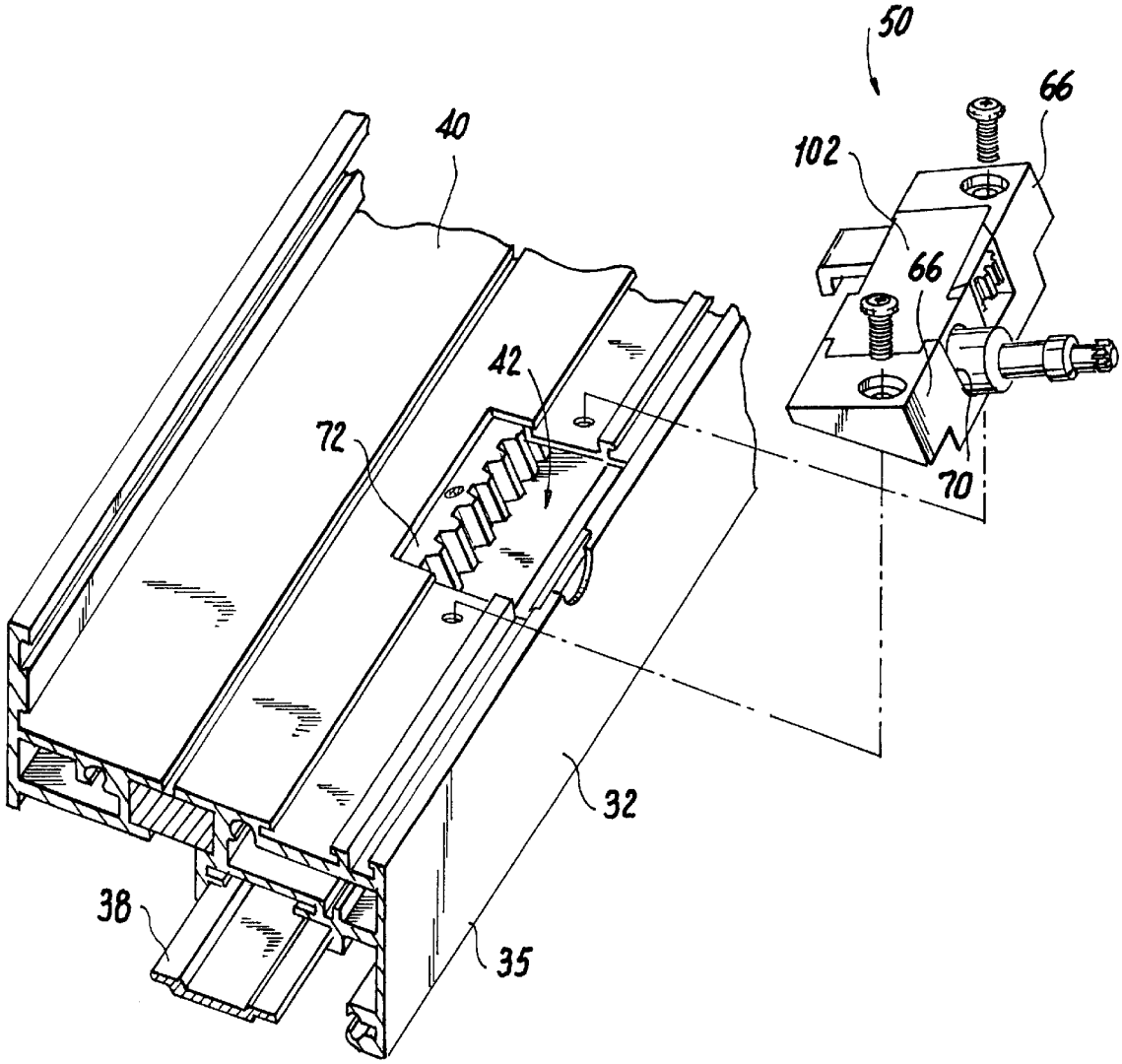
FIG. 6 is a partial exploded perspective of the sash window frame with the mechanical actuator removed for clarity.

Referring to FIGS. 5 and 6, the mechanical actuator 50 is positioned within an aperture 42 formed in the top surface 40 of the bottom portion 32 of the sash window frame 24. A cover 44 may be used to hide the aperture 42 in the bottom portion 32 which holds the mechanical actuator 50. The cover 44 is used to effectively conceal the mechanical actuator 50 in the sash window frame 24. Referring to FIG. 8, it may be seen that the mechanical actuator 50 may include a housing 52 having a base 54 with a front wall 56, opposite back wall 58, a first sidewall 60 and opposite second sidewall 62, extending upward from the base 54 to upper rim 64. The base 54 is positioned so that it sits above the bottom slider 38 of the sash window frame 24 (FIG. 5).

Referring to FIGS. 7 and 8, the mechanical actuator 50 further includes a rack 72 which is preferably directly attached to the bottom slider 38 of the drive train 14. The mechanical actuator 50 has a pinion gear 82 which is rotatably mounted within the housing 52 and mechanically engages the rack 72 positioned on the drive train 14. The pinion gear 82 also engages a worm gear 90 which is rotatably mounted within the housing 52. The worm gear 90 has a shaft 98 extending past the housing 52 along its axis of rotation to connect to a handle 100 which is used to rotate the worm gear 90. The rotation of the handle 100 causes the worm gear 90 to rotate which in turn rotates the pinion gear 82 that is engaged with the rack 72 to move the bottom slider 38 linearly to cause the window to move incrementally from and between any one of the three positions.

The mechanical actuator 50 of the present invention will now be described in further detail. The mechanical actuator 50 has a housing 52 which generally has a rectangular shape. The housing 52 is preferably made of rigid material, such as steel or aluminum. In the preferred embodiment, extending from the second sidewall 62 and first sidewall 60 are two tabs 66, which may be used to attach the housing 52 to the sash window frame 24. Preferably, the tabs 66 are screwed into the bottom portion 32 of the sash window frame 24. The housing 52 is sized such that it may fit within the sash window frame 24 and does not extend outside of the front surface 35 of the sash window frame 24, thus creating a clean aesthetic appearance. The second sidewall 62 and first sidewall 60 are positioned substantially parallel to each other, and extend upward from the housing base 54. The second sidewall 62 and first sidewall 60 are connected to each other by upwardly extending front wall 56 and back wall 58, which are positioned substantially parallel to each other to create the housing 52 with an inner area 65 defined by the four walls. A pinion gear 82 is rotatably mounted within the housing 52 on the housing base 54. The pinion gear 82 may rotate about a pinion shaft 81 which extends substantially perpendicular from the housing base 54. The pinion shaft 81 extends through an aperture 83 in the center of pinion gear which is sized to allow the pinion gear 82 to rotate freely. The pinion gear 82 is preferably mounted so that its axis of rotation extends upward from the housing base 54 to the open space above the housing 52 in a substantially vertical relation. The pinion gear 82 preferably has a pinion gear portion 88 which protrudes out of back wall 58 of the housing 52 through a back wall aperture 68. The pinion gear 82 is sized and positioned so that a pinion gear portion 88 extends through the back wall aperture 68 beyond the back wall 58. The pinion gear 82 has an outer peripheral edge 84 which has a pinion gear surface 86 that engages a corresponding rack 72, and is sized and positioned so that the remainder of the pinion gear 82 which is not extending outwardly past the back wall 58 is positioned within the housing 52.

The mechanical actuator 50 preferably includes a worm gear 90 in mechanical engagement with the pinion gear 82. The worm gear 90 has a cylindrical shape having a proximal end 94 and a distal end 92. The worm gear 90 is preferably positioned in the housing 52 so that the distal end 92 is positioned adjacent the back wall 58 and the proximal end 94 is positioned adjacent the front wall 56. The worm gear 90 is positioned so that its axis of rotation extends from the back wall 58 of the housing 52 to the front wall 56 of the housing 52. The worm gear 90 is rotatably mounted within the housing 52 so as to cooperate with the pinion gear 82. The worm gear 90 preferably has a worm gear surface 96 that engages the pinion gear surface 86. The worm gear 90 engages the pinion gear 82 such that the rotation of the worm gear 90 causes the pinion gear 82 to rotate. The worm gear 90 preferably has a shaft 98 which extends along the axis of rotation of the worm gear through a front wall aperture 70 which is sized to allow free rotation of the shaft 98. The shaft 98 extends out of the housing 52 so that a handle 100 may be attached to the free end 99 of the shaft 98 and so that rotation of the handle 100 rotates the worm gear 90. The housing 52 further includes a top cover 102 which may cover a portion of the inner area 65 of the housing 52. The top cover 102 is preferably positioned so that the pinion shaft 81 may be anchored to the top cover 102.

The pinion gear portion 88 which extends beyond the back wall 58 engages with a rack 72. The rack 72 and pinion gear 82 cooperate such that when the pinion gear 82 is rotated in a clockwise direction, the rack 72 moves in a rightward direction (as seen from viewing FIG. 4), and when the pinion gear 82 is rotated in a counterclockwise direction, the rack 72 is moved in a leftward direction (as seen from viewing FIG. 4). The rack 72 is preferably made of a rigid material such as steel or aluminum. The rack 72 has an upward standing rack back wall 77 which has a plurality of gear rack teeth 79 on its front surface 74 and a smooth back surface 78. The rack 72 further includes a base 80 which may be attached to the bottom slider 38 of the drive train 14. The base 80 is preferably positioned in a substantially perpendicular relation to the rack back wall 77. The rack 72 is preferably positioned so that it is directly connected to the bottom slider 38 of the drive train 14. The rack 72 may be screwed or welded onto the bottom slider 38.

Figure 9:
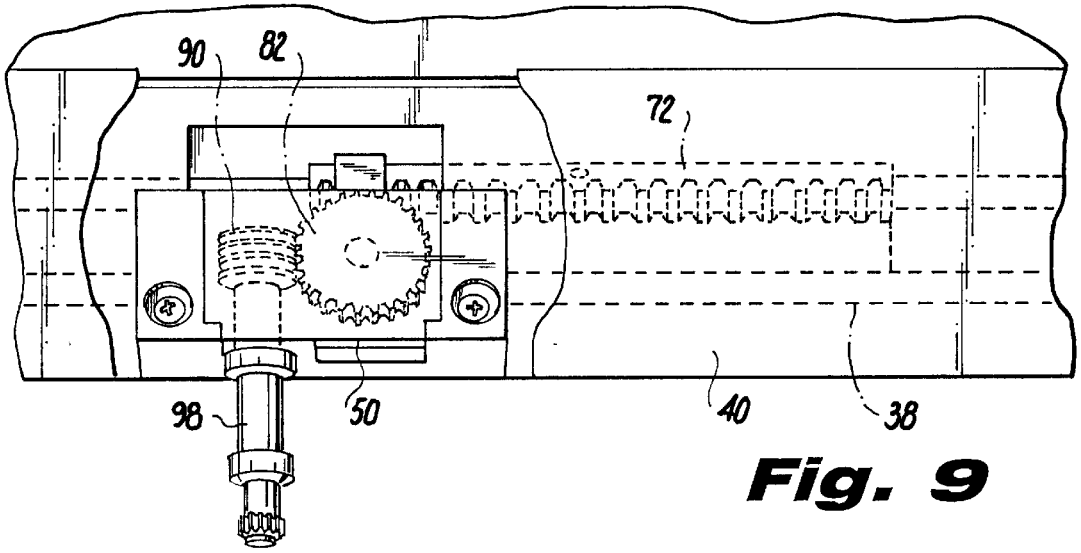
FIG. 9 is a top plan view of the mechanical actuator of the present invention with the drive train in the locked position.

The use of the mechanical actuator 50 will now be described in more detail. Referring to FIG. 9, the multi-position window of the present invention is shown to be in the locked position and the pinion gear 82 is positioned on the portion of the rack 72 corresponding with the locked position in the drive train 14. The rotation of the handle 100 in a counterclockwise direction causes the pinion gear 82 to be rotated by the worm gear 90 in a clockwise direction so that the rack 72 is pushed to in a rightward direction (as seen from viewing FIG. 9). The drive train 14 is configured such that the rightward movement of the rack 72 pushes the bottom slider 38 of the drive train 14 to the right thereby locking the window into the locked first position. The user will be prevented from turning the handle 100 any further in a counterclockwise direction since the movement of the rack 72 to the rightward direction is no longer allowed by the drive train 14. The user has thus locked the window.

Figure 10:
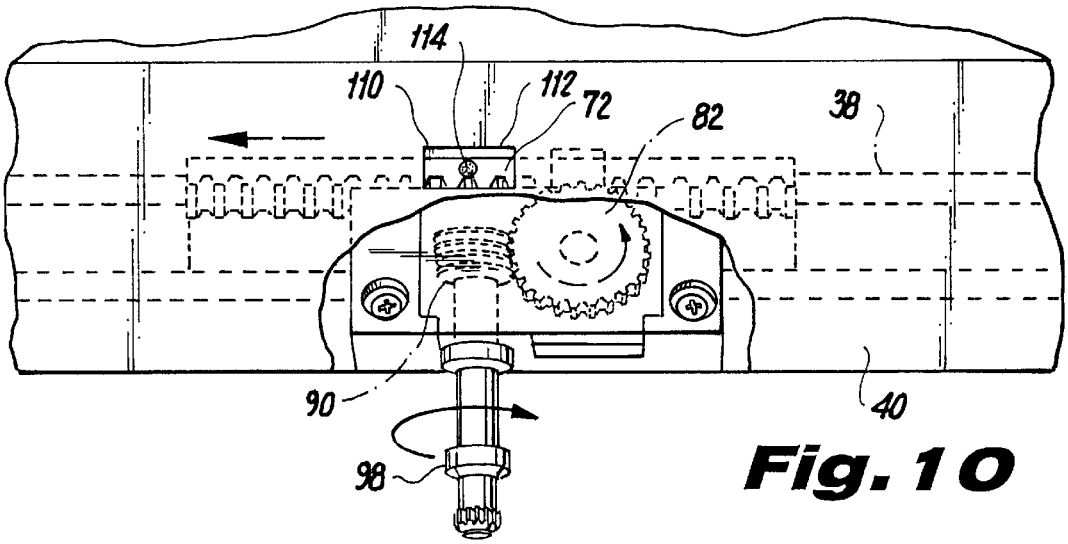
FIG. 10 is a top plan view of the mechanical actuator of the present invention with the drive train allowing rotation about the vertical axis.

Referring now to FIG. 10, in order to open the window along the vertical axis, the user would rotate the handle 100 in a clockwise direction thereby causing the worm gear 90 to rotate the pinion gear 82 in a counterclockwise direction. The counterclockwise rotation of the pinion gear 82 causes the rack 72 to move to the left of the mechanical actuator 50 (as seen from viewing FIG. 10). The movement of the rack 72 in a leftward direction urges the bottom slider 38 in the drive train 14 to the correct position so that the sash window frame 24 may rotate about the vertical axis.

Referring now to FIGS. 5 and 10, in the preferred embodiment, the position that allows the sash window frame 24 to be rotated about the vertical axis may be indicated to the user by use of an indication window 110. In the preferred embodiment, the indication window 110 is a small aperture 112 formed in the top surface 40 of the bottom part 32 of the sash window frame 24 such that, when the user sees a marking 114 on the rack 72 which aligns with the small aperture 112 in the sash window frame 24, the user would know that the window could now be opened about the vertical axis. The marking 114 may be a painted spot on the rack 72.

Figure 11:
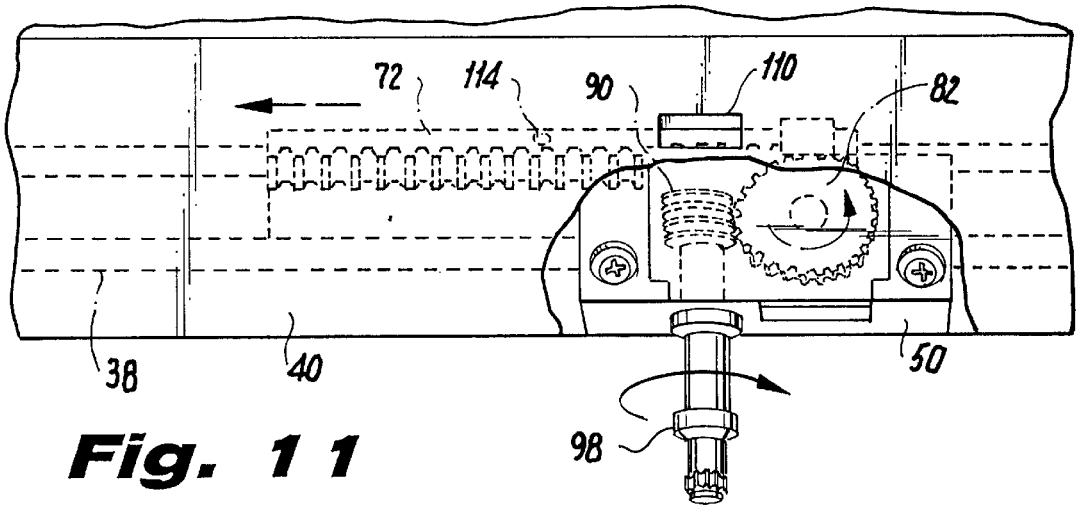
FIG. 11 is a top plan view of the mechanical actuator of the present invention with the drive train allowing rotation about the horizontal axis.

Referring now to FIG. 11, to tilt the window of the present invention, the user would continue to rotate the handle 100 in a counterclockwise position direction and continue to move the rack 72 leftward (as seen from viewing FIG. 11) so that the bottom slider 38 would then be positioned in the correct position for the third position allowing the window to tilt in. The sash window frame 24 fully extending in the tilt in position would then stop the movement of the bottom slider 38 in the drive train 14 thereby stopping the movement of the rack 72. Since the rack 72 can no longer be moved any further, the handle 100 can no longer be turned.

Referring now to FIG. 7, to further increase the reliability of the present invention, the housing 52 may have a top cover 102 with an extension arm 104 which extends laterally out from the housing 52 past the back wall 58 of the housing 52 and protrudes over the top of the rack 72 with an downward extension 106 that closely follows the back surface 78 of the rack 72. The extension arm 104 is used to further increase the rigidity of the rack 72 as it passes over the pinion gear portion 88 extending out from the housing 52. The extension arm 104 is preferably positioned close to the rack 72 so that the rack 72 is allowed to freely slide to the left and right (as seen from viewing FIG. 10). The top cover 102 is preferably securely attached to housing 52 with tack welds.

One advantage of using a worm gear 90 in connection with a pinion gear 82 is that the only way for the rack 72 to move is by the rotation of the worm gear 90. Should the rack 72 be urged to move by the bottom slider 38, such as when the window is open and the sash window frame 24 is pushed by a gust of wind or when a negative pressure situation is experienced, the window does not close, since the pinion gear 82 can only move when actuated by the worm gear 90.

Another advantage of the present invention is that the mechanical actuator 50 of the present invention creates an aesthetically clean appearance since it can be concealed within the sash window frame 24 with only the handle 100 protruding out of the sash window frame 24. In contrast, prior designs have used mechanical actuators which were positioned on the outside of the housing to actuate the drive train, thereby creating an unsightly projection on the outside of the frame.

The present invention may also include a safety lock mechanism 108 for preventing the user from inadvertently opening the sash window frame 24 about the vertical axis. It is possible that the user may inadvertently leave the window in an open/unlock position that allows the window to be opened about the vertical axis and not realize that the window is unlocked. Should a user inadvertently leave the window in the open/unlock position a strong gust of wind may blow the sash window frame 24 open and injure a user in close proximity to the to the window as the sash window frame 24 pivots about the vertical axis.

Referring back to FIG. 4, the present invention may include a safety lock mechanism 108 to prevent opening of the sash window frame 24 about the vertical axis absent the disengagement of the safety lock mechanism 108. Such a safety lock mechanism 108 is well known in the art, such as disclosed in U.S. Pat. No. 5,881,498 to Goggin et al., which is herein incorporated by reference. In order to open the window about the vertical axis, the user would have to align the indication window 110 of the mechanical actuator 50 of the present invention so that the drive train 14 would be in position to allow the rotation of the window about the vertical axis, and only then would the user disengage the safety lock mechanism 108 to allow the window to be opened. The advantage of using this system is that, should the user inadvertently leave the drive train 14 in the position which allows a swing-in opening of the window (i.e., rotation of the window about the vertical axis), the window would still not open unless the safety lock mechanism 108 was disengaged.

Thus, while the foregoing detailed description has disclosed what is presently believed to be the preferred embodiments of the present invention, those skilled in the art would appreciate that other and further changes and modifications can be made without departing from the scope or spirit of the invention, and it is intended that all such other changes and modifications are included in and are within the scope of the invention as described in the appended claims.

What is claimed is:

1. A multi-position window comprising:

a stationary window frame;

a sash window frame positioned within said stationary window frame and non-simultaneously pivotable therein about a vertical axis and a horizontal axis;

a drive train positioned between said sash window frame and said stationary window frame, said drive train being moveable between at least a first position enabling said sash window frame to be pivoted about said horizontal axis, and a second position enabling said sash window frame to be pivoted about said vertical axis; and a mechanical actuator operatively connected to said drive train to move said drive train, said mechanical actuator having a housing secured to and concealed within said sash window frame, a pinion gear rotatably mounted in said housing, a rack attached to said drive train, said pinion gear moveably engaging the rack, and a worm gear rotatably mounted for rotational movement in said housing and moveably engaging said pinion gear, whereby the rotational movement of said worm gear causes said pinion gear to move said rack and said drive train;

wherein the engagement of the worm gear with the pinion gear and the pinion gear with the rack prevents the sash window frame from inadvertently pivoting about the horizontal axis unless the worm gear is rotated by an operator of the multi-position window.

2. A multi-postion window as defined by claim 1, wherein said drive train is further positionable in a closed position preceding said first position, said closed position preventing pivoting of said sash window frame about each of said horizontal axis and said vertical axis.

3. A multi-position window as defined by claim 1, wherein said mechanical actuator is positioned inside said sash window frame.

4. A multi-position window as defined by claim 1, wherein said sash window frame includes a bottom portion, and wherein said mechanical actuator is substantially situated inside said bottom portion of said sash frame.

5. A multi-position window as defined by claim 4, wherein said mechanical actuator further includes a shaft axially connected to said worm gear, whereby rotation of the shaft causes said worm gear to rotate; and further includes a handle attached to said shaft for selectively rotating said shaft and said worm gear.

6. A multi-position window as defined by claim 5, wherein said housing further includes a base, a first sidewall, and an opposite second sidewall, the first and second sidewalls extending upwardly from the base, said second sidewall and said first sidewall being positioned substantially parallel to each other, and a front wall and a back wall connecting said first sidewall and said second sidewall to form said housing having a substantially rectangular shape defining an inner area, said housing having an open upper end.

7. A multi-position window as defined by claim 6, wherein said housing further includes mounting tabs extending outwardly from said housing from said first sidewall and said second sidewall.

8. A multi-position window as defined by claim 7, wherein said pinion gear includes a peripheral edge, a pinion gear surface to engage said rack, said pinion gear surface positioned on said peripheral edge, a pinion gear portion, said pinion gear being positioned in said housing whereby said pinion gear portion extends past said back wall though a back wall aperture.

9. A multi-position window as defined by claim 8, wherein said pinion gear has an axis of rotation which extends substantially perpendicularly from said base of said housing.

10. A multi-position window as defined by claim 9, wherein said worm gear has a distal end positioned adjacent said back wall and a proximal end positioned adjacent said front wall, and whereby the axis of rotation of said worm gear extends from said front wall to said back wall.

11. A multi-position window as defined by claim 10, wherein said worm gear has a gear surface engaging said pinion gear.

12. A multi-position window as defined by claim 11, wherein said rack has a front surface having a gear surface which engages said pinion gear, a back surface, and a base attached to said drive train.

13. A multi-position window as defined by claim 12, wherein said housing further includes a cover which encloses a portion of said housing upper end, said cover having an extension arm extending laterally past said back wall of said housing and over said rack, wherein said rack may slidably move under said extension arm.

14. A multi-position window as defined by claim 13, wherein said extension arm further includes a downward extension that follows said back surface of said rack.

15. A multi-position window as defined by claim 14, further including a safety lock mechanism moveable between an engaged position and a disengaged position, wherein said safety lock mechanism prevents the sash window frame from pivoting about said vertical axis when in the engaged position.

16. A multi-position window as defined by claim 15, which further includes an indication window for alerting the operator that the sash window frame may be pivoted about the vertical axis.

17. A multi-position window as defined by claim 16, wherein said indication window is defined by the bottom portion of the sash window frame, the bottom portion having an aperture formed therein, and wherein said rack includes a marking for indicating when the drive train is in the second position.

18. A multi-position window comprising:

a stationary window frame;

a sash window frame positioned within said stationary window frame and non-simultaneously pivotable therein about a vertical axis and a horizontal axis;

a drive train positioned between said sash window frame and said stationary window frame, said drive train being moveable between at least a first position enabling said sash window frame to be pivoted about said horizontal axis, and a second position enabling said sash window frame to be pivoted about said vertical axis;

a mechanical actuator operatively connected to said drive train to move said drive train, said mechanical actuator having a housing secured to and concealed within said sash window frame, a pinion gear rotatably mounted for rotational movement in said housing, a rack attached to said drive train, said pinion gear moveably engaging the rack, and a worm gear rotatably mounted for rotational movement in said housing and moveably engaging said pinion gear, whereby the rotational movement of said worm gear causes said pinion gear to move said rack and said drive train; and a safety lock mechanism moveable between an engaged position and a disengaged position, wherein said safety lock mechanism prevents the sash window frame from pivoting about said vertical axis when in the engaged position;

wherein the engagement of the worm gear with the pinion gear with the rack prevents the sash window frame from inadvertently pivoting about the horizontal axis unless the worm gear is rotated by an operator of the multi-position window.

19. A multi-position window comprising:

a stationary window frame;

a sash window frame having a bottom portion, a top portion, said top portion positioned opposite said bottom portion, a first side portion, an opposite second side portion, said first side portion and said second side portion extending from said bottom portion to said top portion, said sash window frame positioned within said stationary window frame and non-simultaneously pivotable therein about a vertical axis and a horizontal axis;

a drive train positioned between said sash window frame and said stationary window frame, said drive train being moveable between at least a first position enabling said sash window frame to be pivoted about said horizontal axis, and a second position enabling said sash window frame to be pivoted about said vertical axis;

a mechanical actuator operatively connected to said drive train to move said drive train, said mechanical actuator having a housing secured to and concealed within said sash window frame a pinion gear rotatably mounted in said housing, a rack attached to said drive train, said pinion gear moveably engaging the rack, and a worm gear rotatably mounted for rotational movement in said housing and moveably engaging said pinion gear, whereby the rotational movement of said warm gear causes said pinion gear to move said rack and said drive train;

a safety lock mechanism moveable between an engaged position and a disengaged position, wherein said safety lock mechanism prevents the sash window frame from pivoting about said vertical axis when in the engaged position; and an indication window defined by the bottom portion of the sash window frame, the bottom portion having an aperture formed therein, and wherein rack includes a marking for indicating when the drive train is in the second position;

wherein the engagement of the worm gear with the pinion gear and the pinion gear with the rack prevents the sash window frame from inadvertently pivoting about the horizontal axis unless the worm gear is rotated by an operator of the multi-position window.

* * * * *